United States Patent [19]

Becker et al.

[11] 4,184,791

[45] Jan. 22, 1980

[54] MINE ROOF SUPPORT ASSEMBLY

[75] Inventors: Kunibert Becker, Werl; Burghardt Elsner; Günter Lagodka, both of Lunen, all of Fed. Rep. of Germany

[73] Assignee: Gewerkschaft Eisenhutte Westfalia, Lunen, Fed. Rep. of Germany

[21] Appl. No.: 856,077

[22] Filed: Nov. 30, 1977

[30] Foreign Application Priority Data

Dec. 4, 1976 [DE] Fed. Rep. of Germany ..... 2655076

[51] Int. Cl.[2] ..... E21D 15/44

[52] U.S. Cl. ..... 405/291

[58] Field of Search ..... 61/45 D; 299/31–33; 91/170 MP

[56] References Cited

U.S. PATENT DOCUMENTS

| | | | |
|---|---|---|---|
| 3,431,738 | 3/1969 | Groetschel | 61/45 D |
| 3,448,584 | 6/1969 | Rieschel | 61/45 D |
| 3,504,944 | 4/1970 | Holz et al. | 299/32 |

FOREIGN PATENT DOCUMENTS

| | | | |
|---|---|---|---|
| 1608292 | 12/1970 | Fed. Rep. of Germany | 61/45 D |
| 2047769 | 4/1971 | Fed. Rep. of Germany | 61/45 D |
| 2355234 | 5/1975 | Fed. Rep. of Germany | 61/45 D |
| 1492586 | 11/1977 | United Kingdom . | |

*Primary Examiner*—Dennis L. Taylor

*Attorney, Agent, or Firm*—Sughrue, Rothwell, Mion, Zinn and Macpeak

[57] ABSTRACT

A mine roof support assembly comprises three basically similar mine roof support units positioned in a side-by-side relationship along a beam. The central unit is fastened to the beam for movement therewith, and the two outer units are flexibly connected to the beam by respective guide rod assemblies. Each of the outer units is provided with an alignment device, such as a short working stroke hydraulic ram, which acts on the beam in the direction of the longitudinal axis of the beam.

12 Claims, 3 Drawing Figures

MINE ROOF SUPPORT ASSEMBLY

BACKGROUND TO THE INVENTION

This invention relates to a mine roof support assembly constituted by three mine roof support units positioned side-by-side along a beam.

A known form of assembly of this type has the central unit fastened to the beam for movement therewith and the two outer units connected to the beam by means of respective guide rod assemblies. Where the floor of the mine working is uneven, or where there is a relatively steep incline or dip in the floor level, problems arise in ensuring satisfactory alignment of the units and the beam. This is particularly troublesome when the assembly is used as a support for a longwall face.

DT-OS 2,337,218 described a mine roof support assembly of this type in which the central unit forms an abutment for the advance of the two outer units. The guide rod assemblies of the outer units are constituted by resilient guide rods connected to the beam, and the advance rams of the outer units are also connected to the beam. In order to align this assembly, an aligning ram is positioned between the central unit and the outer unit which lies below it down the incline, the purpose of this alignment ram being to align the central unit relative to the beam and thus also relative to the two outer units. However, it is not always possible with this assembly to align the beam itself.

DT-OS 1,583,091 describes an assembly having three mine roof support units, the two outer units being connected by alignment rams which are positioned between these two units in the manner of guide bars. A separate alignment device, associated with these rams, is provided for aligning the central unit. This type of arrangement is not suitable, however, for the type of assembly having a beam fastened to the central unit.

DT-OS 2,453,225 describes a longwall face mine roof support assembly constituted by three units. Here, the central unit carries a generally U-shaped guide bar, the two parallel arms of which form guide rods for the two outer units. The U-shaped guide bar is longitudinally adjustable by means of an alignment ram so that the spacing of the units can be varied. Again this type of arrangement is not suitable for the type of mine roof support assembly which has a beam fastened to its central unit.

It is the main object of the invention to construct a mine roof support assembly of the type defined above which permits all the units and the beam to be aligned even where the floor level of the mine working dips appreciably and without the adaptability of the individual units to any uneveness of the floor being affected.

SUMMARY OF THE INVENTION

The present invention provides a mine roof assembly comprising three mine roof support units positioned side-by-side along a beam, the central unit being fastened to the beam for movement therewith, and each of the two outer units being connected to the beam by means of a respective guide rod assembly, wherein each of the outer units is provided with an alignment device which acts on the beam, whereby the beam is displaceable in the direction of its longitudinal axis.

Preferably, each of the alignment devices acts between the corresponding outer unit and the guide rod which connects that unit to the beam. With this form of assembly, it is possible to displace the beam in the direction of its longitudinal axis, that is to say in the longitudinal direction of a longwall face. Thus, by using the alignment devices associated with the two outer units, it is possible to adjust the position of the beam to account for the effect of any incline in the floor level of the mine working. Since the central unit is fastened to the beam for movement therewith, this unit is automatically aligned together with the beam. The outer units can then be aligned relative to the beam by means of their guide rod assemblies. Consequently, alignment rams, which are interposed in the manner of guide rods between adjacent pairs of units, are not required.

Advantageously, each alignment device comprises an alignment ram whose piston rod carries a coupling member which transmits force to the beam via the associated guide rod assembly. Each coupling member may be provided with an aperture through which the corresponding guide rod assembly passes with a vertical clearance. Preferably, each alignment ram is mounted so that its working stroke lies in a direction parallel to the longitudinal axis of the beam. This means that alignment rams having only a short working stroke can be utilised.

Each coupling member may be fixed to a respective push rod which is connected to the corresponding piston rod by means of a bridge member, each push rod being parallel to the associated piston rod. Thus, each alignment ram forms a compact unit together with its push rod and coupling member, and so can be interposed between the front end of its guide rod assembly and the beam.

Preferably, the guide rod assembly of each outer unit is constituted by a respective resilient guide rod whose front end is connected to the beam and whose rear end is slidably supported on guide means provided on the corresponding unit, and each guide rod is pivotally connected at its front end to the beam. Advantageously, the rear end of each guide rod is provided with a transverse yoke which slides on said guide means.

Each of the outer units may be provided with an advance ram whose working stroke lies in a direction substantially perpendicular to the longitudinal axis of the beam. In this case, each advance ram may be pivotally connected to the corresponding transverse yoke.

Each support unit may have a floor sill, and each alignment device may be mounted on upstanding parallel brackets projecting upwards from the front end of the corresponding floor sill. Preferably, each of the floor sills is constituted by two parallel, spaced apart sections. In this case, said upstanding brackets project upwards one from each section of each floor sill, and the guide rod assembly of each outer unit is mounted in the space between the two sections of the floor sill of that unit. It is also convenient for the advance ram of each outer unit to be mounted above the guide rod assembly of that unit.

Preferably, the central unit is connected to the beam by means of a pair of resilient guide rods, and the resilient guide rods of the central unit are mounted in the space between the two sections of the floor sill of that unit.

Usually, the beam is connected to, or forms part of, the longwall conveyor provided adjacent to the longwall face for removing won material. Thus, this type of assembly can also be used for aligning and anchoring a longwall conveyor.

The invention also provides a method of aligning a mine roof support assembly which comprises three mine roof support units positioned side-by-side along a beam, the central unit being fastened to the beam for movement therewith and each of the two outer units being connected to the beam by means of a respective guide rod assembly, the method comprising the steps of aligning the beam and the central unit by means of alignment devices associated with the two outer units, with the two outer units anchored, and aligning the two outer units by means of their guide rod assemblies with the central unit anchored.

BRIEF DESCRIPTION OF THE DRAWINGS

A mine roof support assembly constructed in accordance with the invention will now be described, by way of example, with reference to the accompanying drawings, in which.

DESCRIPTION OF PREFERRED EMBODIMENT

Figure 1:
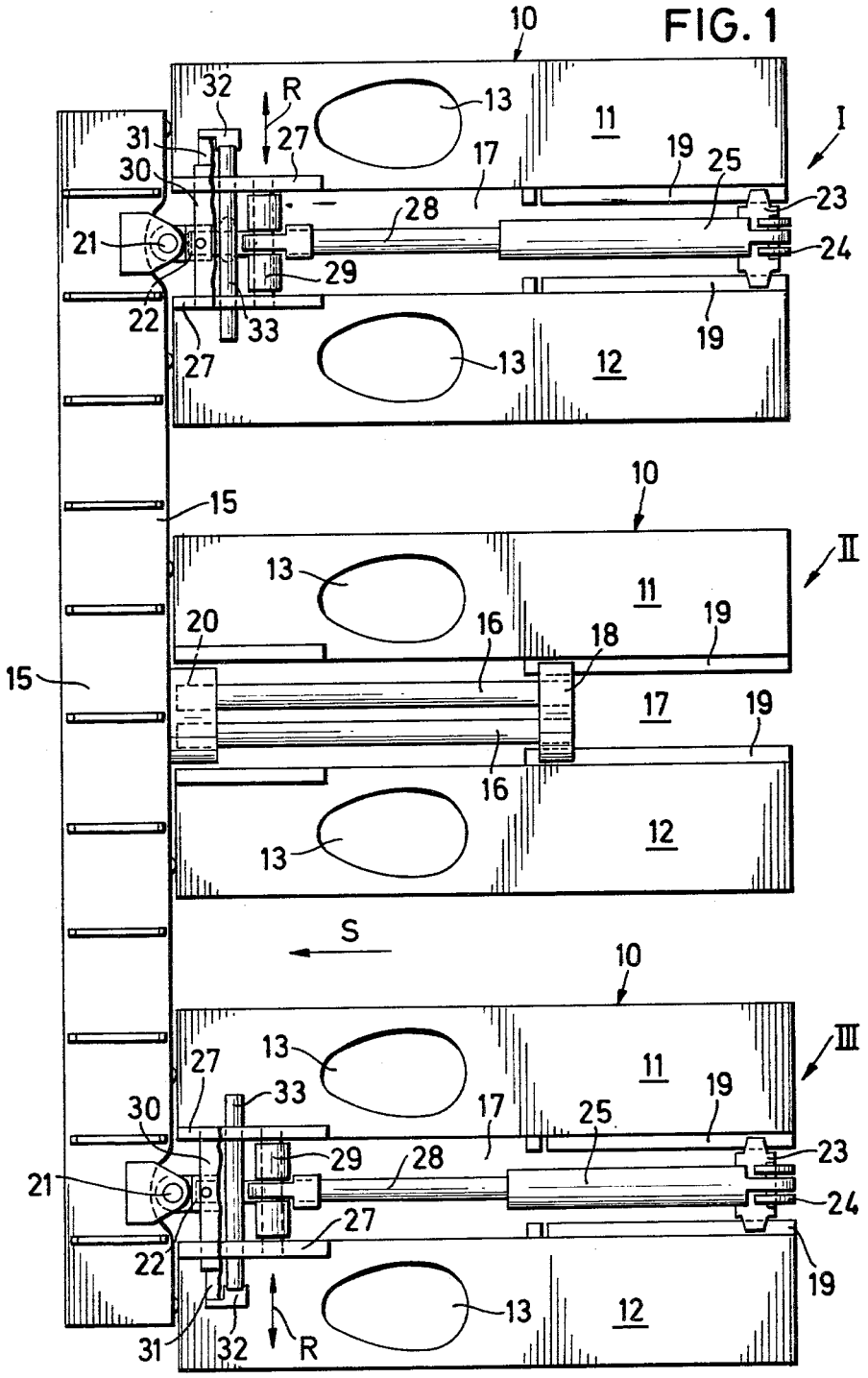
FIG. 1 is a plan view of three adjacent units of the mine roof support assembly.
Figure 2:
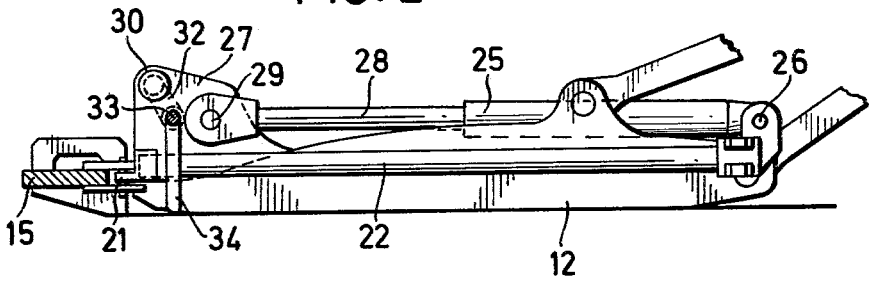
FIG. 2 is a part-sectional side elevation through one of the units of FIG. 1.
Figure 3:
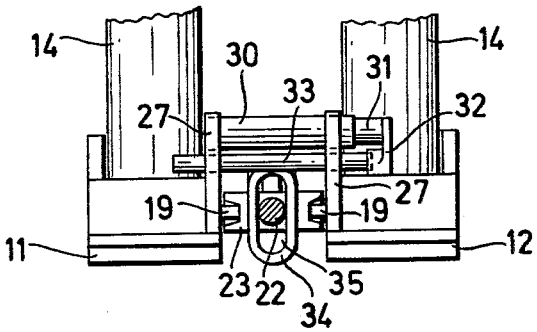
FIG. 3 is an end elevation of the unit of FIG. 3.

Referring to the drawings, FIG. 1 shows a mine roof support assembly comprising three basically similar units I, II and III arranged in a side-by-side, parallel relationship. Each unit I, II and III has a floor sill structure 10 which supports two hydraulic telescopic props 14 connected thereto by ball-and-socket joints 13. The floor sill structure 10 of each unit I, II and III is effectively sub-divided in the longitudinal direction, that is to say in the direction S of advance, and composed of separate sill sections 11 and 12. The heads of the props 14 support a roof cap (not shown) either directly, or indirectly by supporting a goaf shield (not shown) hinged thereto.

The central unit II is connected to a beam 15 by means of two resilient guide rods 16 which are located in the space 17 between the two floor sill sections 11 and 12, the rear (goaf side) ends of the rods being fixed to a transverse yoke 18 which is mounted on guides 19 fixed to the inner lateral faces of the sections 11 and 12. The front (working face side) ends of the rods 16 are fixed to a block 20 which in turn is fixed to the beam 15. The central unit II is then connected to the beam 15 in such a manner that, apart from slight movements for taking up any uneveness in the floor of the mine working the two parts act as one during advance of the assembly.

Each of the outer units I and III is connected to the beam 15 by means of a respective guide rod assembly 22 and vertical pivot joint 21. Each guide rod assembly 22 is constituted by a single resilient guide rod located in the space 17 between the two floor sill sections 11 and 12 of the unit I or III in question. The rear (goaf side) end of each guide rod 22 is fixed to a transverse yoke 23 which is slidably mounted on guides 19 fixed to the inner lateral faces of the corresponding floor sill sections 11 and 12. The cylinder 25 of a respective hydraulic advance ram is pivotally connected (about a horizontal pivot 26) to a pair of brackets 24 attached to each of the transverse yokes 23. The rams 25 are positioned above the corresponding guide rods 22 and their piston rods 28 are pivotally connected (about corresponding horizontal pivots 29) to pairs of parallel brackets 27 attached to the floor sill sections 11 and 12 at the front (working face) ends of the units I and III.

The brackets 27 also support short-stroke hydraulic alignment rams 30 whose axes lie parallel to the longitudinal axis of the beam 15. Each ram 30 is mounted to its support brackets 27 in such a manner that its cylinder cannot move relative thereto in the direction of the longitudinal axis of the beam, whereas the floor sill sections 11 and 12 are vertically movable, to a limited extent, relative to the cylinder. The piston rod 31 of each ram 30 is rigidly connected, via a bridge member 32, to a respective push rod 33 which is arranged parallel to, and beneath the corresponding ram 30. Each push rod 33 is guided in guide apertures (not shown) in the corresponding brackets 27. An oval link 34 is fastened to the underside of each push rod 33, the corresponding guide rod 22 passing through each link with a limited vertical freedom of movement.

In use, if the alignment rams 30 of the outer units I and III are pressurised, the push rods 33 will be displaced by the extending (or retracting) piston rods 31 in the direction of the arrow R. As the links 34 are fixed to their push rods 33, they also move in the direction of the arrow R. Thus, if the props 14 of the central unit II are not pressurised, the beam 15 together with the central unit II will also be displaced in the direction R, that is to say in the longitudinal direction of the longwall working face. The force from the alignment rams 30 is, thus, transmitted via the links 34 and the resilient guide rods 22 to the beam 15. Because of their resilience, the guide rods 22 may also be elastically deformed, in the direction of the applied force, during this alignment process. After the beam 15 has been aligned in this manner, and after the central unit II has been re-anchored by subjecting its props 14 to pressure, the two outer units I and III are aligned with respect to the beam 15, once their props 14 are depressurised, by means of their guide rod assemblies 22.

The advance of the roof support assembly in the direction S is effected in the usual way by means of the advance rams 25, the central unit II being advanced first (together with the beam 15), and the two outer units I and III then being advanced in a follow-up sequence. During the advance of the central unit II its props 14 are depressurised and the two outer units I and III form abutments for the advance, and during the advance of the outer units their props 14 are depressurised and the central unit acts as an abutment.

The three units I, II and III may be supported against one another in the goaf side area. This can be effected by means of laterally extensible side bars known per se which are arranged on the goaf shields.

In view of the fact that the guide rod assemblies of the two outer units I and III each comprise only a single guide rod 22 which is located in the relatively large space 17 between the corresponding floor sill sections 11 and 12, it is possible to displace the beam 15 from its represented central position by approximately 50 to 100 millimeters in either direction R.

We claim:

1. A mine roof support assembly comprising three mine roof support units positioned side-by-side along a beam, the central unit being fastened to the beam at an invariant distance therefrom for movement therewith, each of the two outer units being connected to the beam adjacent to a respective end thereof by means of a respective guide rod assembly, each of the outer units being provided with an alignment device which acts on the beam, whereby the beam is displaceable in the direction of its longitudinal axis, each alignment device comprising an alignment ram whose piston rod carries a coupling member which transmits force to the beam via the associated guide rod assembly, and wherein each coupling member is fixed to a respective push rod which is connected to the corresponding piston rod by means of a bridge member, each push rod being parallel to the associated piston rod.

2. A mine roof support assembly comprising three mine roof support units positioned side-by-side along a beam, the central unit being fastened to the beam at an invariant distance therefrom for movement therewith, each of the two outer units being connected to the beam adjacent to a respective end thereof by means of a respective guide rod assembly, each of the outer units being provided with an alignment device which acts on the beam, whereby the beam is displaceable in the direction of its longitudinal axis, and wherein the guide rod assembly of each outer unit is constituted by a respective resilient guide rod whose front end is connected to the beam and whose rear end is slidably supported on guide means provided on the corresponding unit.

3. An assembly according to claim 2, wherein each guide rod is pivotally connected at its front end to the beam.

4. An assembly according to claim 2, wherein the rear end of each guide rod is provided with a transverse yoke which slides on said guide means.

5. An assembly according to claim 4, wherein each of the outer units is provided with an advance ram whose working stroke lies in a direction substantially perpendicular to the longitudinal axis of the beam.

6. An assembly as claimed in claim 5, wherein each advance ram is pivotally connected to the corresponding transverse yoke.

7. A mine roof support assembly comprising three basically similar mine roof support units positioned side-by-side along a beam, the central unit being fixed to the beam in a substantially rigid manner for movement therewith in a substantially fixed position relative thereto, and each of the two outer units being flexibly connected to the beam by means of a respective resilient guide rod, each of the outer units being provided with an alignment device which acts between that unit and the guide rod which connects that unit to the beam, whereby the beam is displaceable in the direction of its longitudinal axis, wherein each alignment device is constituted by a short working stroke alignment ram mounted so that its working stroke lies in a direction parallel to said longitudinal axies of the beam, the piston rod of each said alignment ram carrying a coupling member which transmits force to the beam via the associated guide rod, the coupling members each being provided with an elongate aperture through which the corresponding guide rod passes with a vertical clearance.

8. A mine roof support assembly comprising:

three mine roof support units horizontally positioned side-by-side along a beam extending along a mineral long face in a mine;

means fixing the central roof support unit to said beam for movement therewith in both the direction of the longitudinal axis of said beam and also in the direction toward the face;

individual guide rod means extending in a direction perpendicular to the longitudinal axis of said beam and pivotally connecting each of the units to a respective end of said beam for permitting longitudinal movement of said beam relative to said outer units;

individual ram means, mounted on each outer unit and coupled to said beam, for displacing said beam and central unit relative to said outer units in the longitudinal direction of said beam, the stroke of said ram means being in a direction parallel to the longitudinal axis of said beam; and means for anchoring the outer ends during the longitudinal displacement of the said beam.

9. An assembly according to claim 8 further comprising individual coupling means coupling said individual guide rod means to the piston rods of the corresponding individual ram means so that movement of the piston rod is transmitted through said guide rod means to said beam.

10. An assembly according to claim 9 wherein each coupler means is provided with an aperture through which the corresponding guide rod means passes with a vertical clearance.

11. An assembly according to claim 9 wherein each support unit has a floor sill formed by two parallel, spaced apart sill sections, wherein each ram means is mounted on upstanding parallel brackets projecting upwards from the front end of the corresponding floor sill, wherein the guide rod means of each outer unit is mounted in the space between the two sill sections of that unit, and wherein said fixing means for the central unit comprises a pair of resilient guide rods mounted in the space between the sill sections of that unit.

12. An assembly according to claim 9 further comprising an advance ram on each of said outer units and having a working stroke in a direction substantially perpendicular to the longitudinal axis of said beam.

* * * * *